US006225962B1

(12) United States Patent
Blanchard et al.

(10) Patent No.: US 6,225,962 B1
(45) Date of Patent: May 1, 2001

(54) APPARATUS AND METHOD FOR AN ADJUSTABLE LINKAGE

(75) Inventors: Anthony Charles Blanchard, Scarborough; Francis Hamilton Farnum, III, Falmouth, both of ME (US)

(73) Assignee: Gabriel Electronics Incorporated, Scarborough, ME (US)

( * ) Notice: Subject to any disclaimer, the term of this patent is extended or adjusted under 35 U.S.C. 154(b) by 0 days.

(21) Appl. No.: 09/156,113

(22) Filed: Sep. 18, 1998

(51) Int. Cl.[7] ..... H01Q 1/08

(52) U.S. Cl. ..... 343/880; 343/765; 343/882; 343/892; 248/514

(58) Field of Search ..... 343/757, 765, 343/880, 882, 878, 890, 881, 766, 892, 723, 823, 901, 902; 248/201, 237, 514, 155.3, 155.4, 479, 480

(56) References Cited

U.S. PATENT DOCUMENTS

| | | | | |
|---|---|---|---|---|
| 2,840,199 | * | 6/1958 | Marris | 343/882 |
| 4,086,599 | | 4/1978 | VanderLinden, Jr. et al. | 343/881 |
| 4,251,819 | | 2/1981 | Vickland | 343/882 |
| 4,454,515 | * | 6/1984 | Major et al. | 343/882 |
| 4,563,687 | | 1/1986 | Berger | 343/882 |
| 4,598,297 | * | 7/1986 | Hawkins | 343/882 |
| 4,656,486 | * | 4/1987 | Turner | 343/882 |
| 4,799,642 | * | 1/1989 | Wright | 248/516 |
| 4,819,007 | | 4/1989 | Tezcan | 343/840 |
| 4,821,047 | * | 4/1989 | Williams | 343/882 |
| 4,868,578 | | 9/1989 | Bruinsma et al. | 343/882 |
| 5,469,182 | * | 11/1995 | Chaffee | 343/882 |
| 5,646,638 | | 7/1997 | Winegard et al. | 343/882 |
| 5,941,497 | * | 8/1999 | Inoue et al. | 248/514 |
| 5,945,961 | * | 8/1999 | Price et al. | 343/757 |
| 6,043,795 | * | 3/2000 | Strieffler et al. | 343/890 |

* cited by examiner

*Primary Examiner*—Tho Phan
(74) *Attorney, Agent, or Firm*—Bromberg & Sunstein LLP

(57) ABSTRACT

A method and apparatus for linkage adjustment. In an embodiment, the adjustable linkage includes a first component, a second component and locking device. The first component has a plurality of spaced slots and a connector for connecting to an object. The second component also has a plurality of spaced slots and a connector for connecting to a second object. The locking device holds the first component and the second component in a fixed relative position. The components are positioned so a first slot from the first component overlaps with a first slot from the second component. A lever may be inserted through the first slot of the first component and into the first slot of the second component to apply a prying force. The prying force relatively repositions the components such that a second slot from the first component is brought into overlapping relationship with a second slot from the second component. In other embodiments the plurality of slots from the first component and the second component may be positioned in a linear path or about an arc. In another embodiment, the adjustable linkage may be part of an antenna mount for adjusting azimuth panning and vertical panning.

36 Claims, 7 Drawing Sheets

APPARATUS AND METHOD FOR AN ADJUSTABLE LINKAGE

TECHNICAL FIELD

The present invention relates to adjustable mounting devices and more specifically to antenna mounting devices with micro adjustment.

BACKGROUND ART

The nature of a typical point-to-point microwave antenna is such that the width of the signal beam is relatively narrow and must be aimed accurately at another antenna, perhaps miles away. Typical antenna mounts include devices which enable the installer to aim the antenna in both azimuth (horizontal rotation) and vertical pitch (vertical rotation). After beam alignment, the mount hardware can be tightened to fix the antenna in this position. A typical adjustment device provides two functions. It must provide sufficient mechanical advantage so that the installer can, with basic hand tools (i.e. wrenches or screw drivers), easily overcome the friction of the azimuth and vertical panning. It must also allow the installer to move the antenna small amounts, typically fractions of a degree, so that precise alignment can be achieved. Some type of screw mechanism is a common adjustment device.

A screw mechanism provides both mechanical advantage and the necessary precision, however they can be relatively expensive for use in low-cost mounts, the screw threads can be damaged causing the device to jam or malfunction, and the added bulk and complication of the additional parts may be unsightly.

SUMMARY OF THE INVENTION

The invention provides, in a preferred embodiment an adjustable linkage and method for using an adjustable linkage. In an embodiment, the adjustable linkage may be part of an antenna mount for adjusting azimuth panning and vertical panning.

In another embodiment, the adjustable linkage includes a first component, a second component and locking device. The first component has a plurality of spaced slots and the second component also has a plurality of spaced slots. The locking device holds the first component and the second component in a fixed relative position. The locking device may be loosened so that friction maintains the relative position of the components. The components are positioned so a first slot from the first component overlaps with a first slot from the second component. A lever may be inserted through the first slot of the first component and into the first slot of the second component to apply a prying force. The prying force relatively repositions the components such that a second slot from the first component is brought into overlapping relationship with a second slot from the second component. In other embodiments the plurality of slots from the first component and the second component may be positioned in a linear path or about an arc. The locking device may include two aligned locking slots and a bolt passing therethrough.

BRIEF DESCRIPTION OF THE DRAWINGS

The foregoing features of the invention will be more readily understood by reference to the following detailed description, taken with reference to the accompanying drawings, in which.

DETAILED DESCRIPTION OF THE SPECIFIC EMBODIMENTS

Figure 1A:
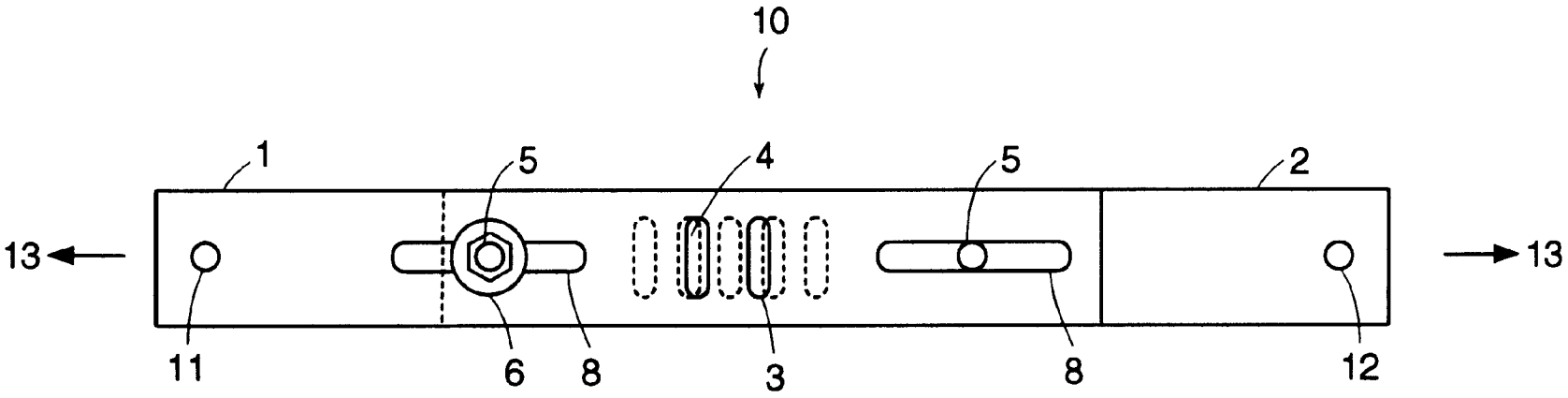
FIG. 1A is a top view of one embodiment of the invention of a linkage adjustment assembly.
Figure 1B:
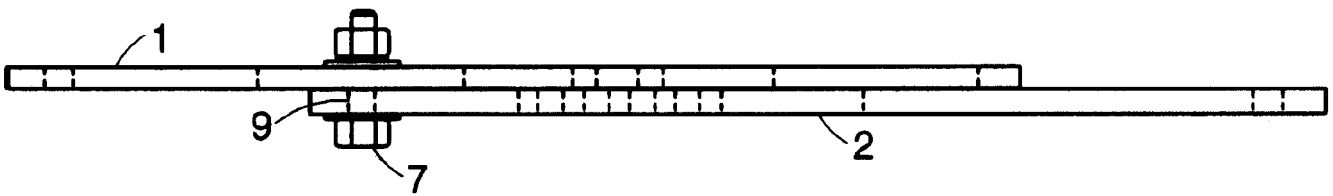
FIG. 1B is a side view of one embodiment of the invention of a linkage adjustment assembly.

FIG. 1A and FIG. 1B, a linkage assembly 10 is shown. A first component 1 with a plurality of adjustment slots 3 is positioned adjacent to a second component 2 which is below the first component 1. It is not necessary that the first component 1 and the second component 2 touch. The first and second component 1,2 may be positioned so that there is either space between the two components or even a separate material (spacer) therebetween. The first component 1 has a connector 11 and the second component 2 has a connector 12. In FIG. 1A the connector for both components is a hole for receiving a pin or bolt. These connectors 11,12 are used for attaching the linkage to two or more objects. For example, the linkage assembly may be connected to a security camera and a mount. In an alternative embodiment, the linkage assembly may not have connectors, wherein each component might be an integral part of an object or the assembly might be bonded or welded to the objects. In an embodiment the components may be plates. Adjustment slots 3 of the first component 1 are initially positioned so that at least one of the slots 3 in the first component 1 overlaps with at least one slot of the second component 2 as shown by overlapping area 4. Locking device is provided and is shown in the figure to be a nut 6 and bolt 7. The bolt 7 passes through a locking slot 8 which may be in either the first component 1 or the second component 2 and the bolt 7 also passes through a hole 9 in the other component, which in FIG. 1A is the second component 2. The locking device 5 allows the first and second component 1,2 to be locked in a relative position. The slot 8 of the locking device 5 provides a range of adjustment for the linkage adjustor 10 which is equivalent to the length of the slot 8. The component having the slot may be repositioned relative to the other component which does not have the slot. The locking device 5 also provides a way of restraining the degrees of freedom of movement of the two components to a single degree of freedom. In FIG. 1 the locking device restrains the freedom of movement to the horizontal axis so that as the components are repositioned only the overall length, 13 of the linkage changes and no other dimension of the linkage adjustor 10 is altered. Washers, and more specifically spring washers, such as Belleville springs, may be used in conjunction with the locking device. As the locking device is loosened, the Belleville spring continues to apply pressure resulting in friction between the first and second components so that the first and second components are not repositioned due to forces from the two objects to which the components are attached. In another embodiment, where the external forces placed on the linkage are minimal, the friction produced by the locking device may be set and subsequent linkage adjustments using a lever may be made without loosening the locking device. In such an embodiment, the friction may be maintained by spring washers.

Figure 3A:
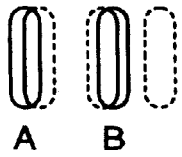
FIGS. 3A–D is a top view of the adjustment slots of one embodiment of the linkage adjustment assembly showing the adjustment slots in various states of transition.
Figure 2A:
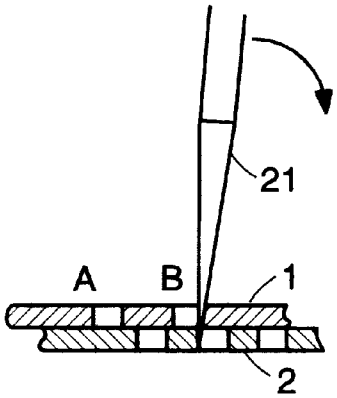
FIGS. 2A–D is a side view of one embodiment of the invention of the linkage adjustment assembly showing the adjustment slots in various states of transition.

Minor adjustments of the linkage can be made with lever 21 which may be a flat blade screwdriver or other tool inserted through the overlapping slots as shown in FIG. 2A and FIG. 3A designated slot B. Slot B corresponds to the first slot of the first component 1 and the second slot of the second component 2. The lever 21 engages a side, here a right side, of the first slot of the first component and an opposite side, the left side, of the second slot of the second component. The lever is then moved, applying a prying force to the components in opposite directions. The first component receives force to the right and the second component receives force to the left. The first component is moved to the right relative to the second component (FIG. 2A and FIG. 3A).

Figure 3B:
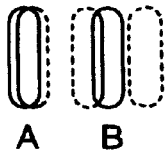
Figure 3C:
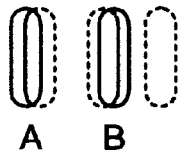
Figure 3D:
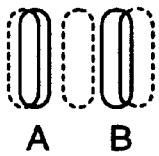
Figure 2B:
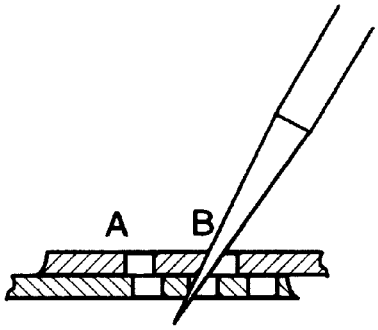
Figure 2C:
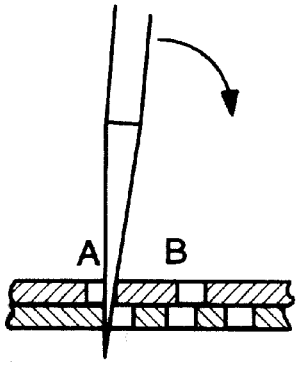
Figure 2D:
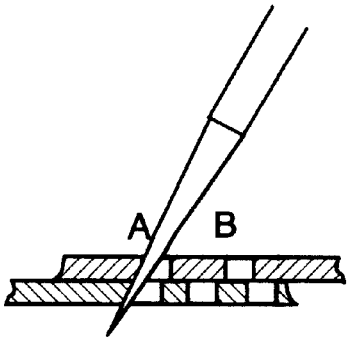

The first component is shifted to the right enough that a second slot of the first component is brought into overlapping relation with the third slot in the second component as designated by slot A (FIG. 2B and FIG. 3B). The lever may then be repositioned so that it passes through the components at slot A (FIG. 2C and FIG. 3C). Again the lever engages a side, here the right side, of the second slot of the first component and an opposite side, here the left side, of the third slot of the second component. The lever can be moved again repositioning the first component relative to the second component (FIGS. 2C and 3C). This second movement of the lever positions the first slot of the first component over the first slot of the second component so that the linkage may continue to be adjusted (FIGS. 2D and 3D). This process of inserting a lever, prying the lever and reinserting the lever provides micro adjustment of the linkage. This process may be reversed by performing the foregoing steps in reverse order.

Figure 4:
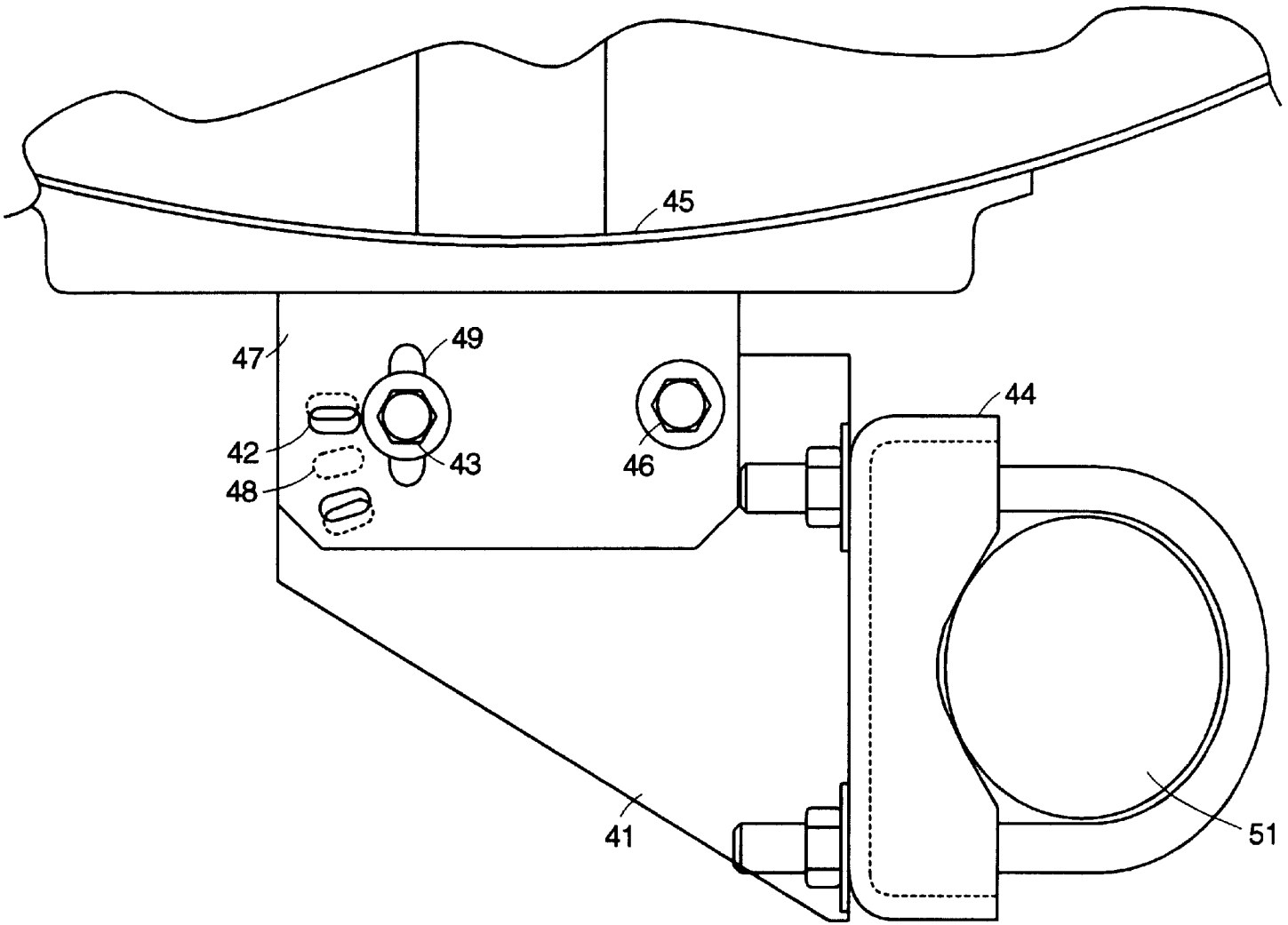
FIG. 4 is a top view of an embodiment of the linkage adjustment assembly in an antenna mount.

One example of such a system requiring a linkage assembly capable of being micro adjusted is a microwave antenna. Since microwaves travel in a narrow path the alignment of microwave antennas often requires small adjustments in the position of the antenna over fractions of a degree in vertical pitch or in azimuth panning. The adjustment of the azimuth and the vertical pitch of an antenna may be accomplished with the embodiment of FIG. 4. FIG. 4 is a top view of an antenna mount 40 showing the components that are used in azimuth adjustment. A bracket 44 is used for attaching the antenna 45 to a pole 51 or other stable object. The bracket 44 is attached to a first component 41 which has adjustment slots 48. The adjustment slots 48 are spaced apart and are designed to receive engagement from a lever such as a flat blade screw driver or other tool. A second component 47 positioned adjacent and above the first component is attached to the antenna 45 and it also has adjustment slots 42. The adjustment slots 42,48 of both components are arranged in an arc and a slot from the first component 41 and the second component 47 slightly overlaps. In this embodiment, mount locking device 46 provides an axis of rotation about which the antenna 45 may rotate. The mount locking device 46 might be a pivot pin. Although the components may be repositioned with respect to each other rotationally in this embodiment, in other embodiments of the invention, the components may be repositioned linearly. Mount locking device 43 is a nut and bolt, the bolt passes through a locking slot 49 in the second component 47 and a hole in the first component 41. The locking slot 49 defines a range of movement over which the second component 47 may rotate relative to the first component 41 during adjustment. The locking slot 49 may be in either the first or second component or in both.

Figure 5:
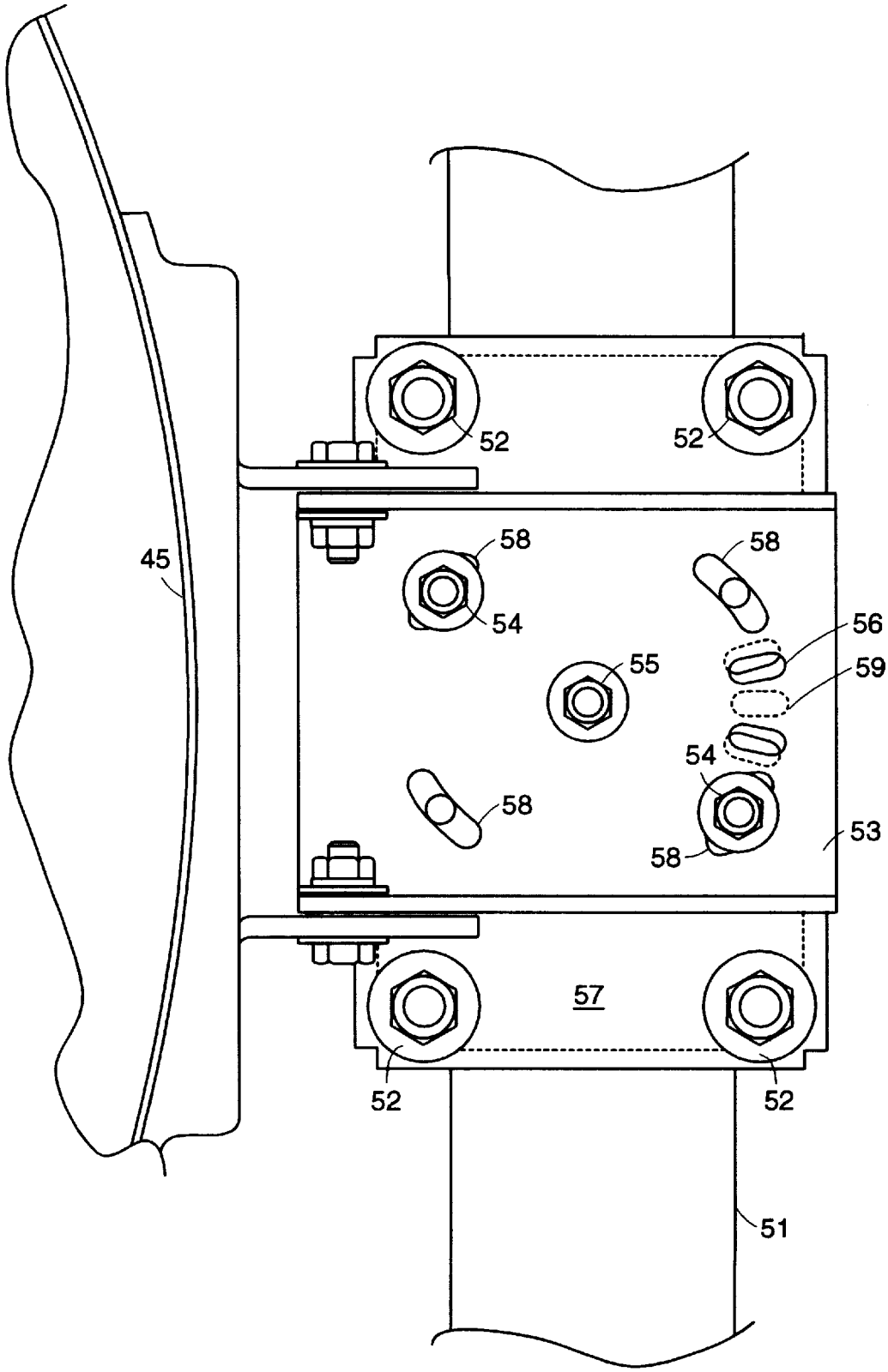
FIG. 5 is a side view of an embodiment of the linkage adjustment assembly in an antenna mount.

FIG. 5 provides a side view of the antenna mount 40. From this view the pole 51 and the pole mounting device 52 of the bracket 44 are shown. As with the azimuth adjustment, there are two components for vertical adjustment which are positioned adjacent one another, a top component 53 and a bottom component 57 which is integral to bracket 44. In this embodiment, there are five bolts which constitute the locking device. The four outer bolts 54 each fit through a locking slot 58. Each locking slot forms an arc allowing for the top component 53 to be rotated with respect to the bottom component about the center of the component. The fifth bolt or pin 55 passes through the center of the top and bottom components 53,57 and is located at the axis of rotation. The top component 53 and bottom component 57 each have adjustment slots 56,59, such that when the top component 53 is placed over the bottom component at least one of the slots overlaps, allowing for a lever to be inserted therethrough. The adjustment slots 56 of the top 53 and the bottom component are arranged in an arc. The arc formed by the adjustment slots 56 of the bottom component 57 and the arc formed by the adjustment slots 59 of the top component 53 each have the same center of curvature.

Figure 6:
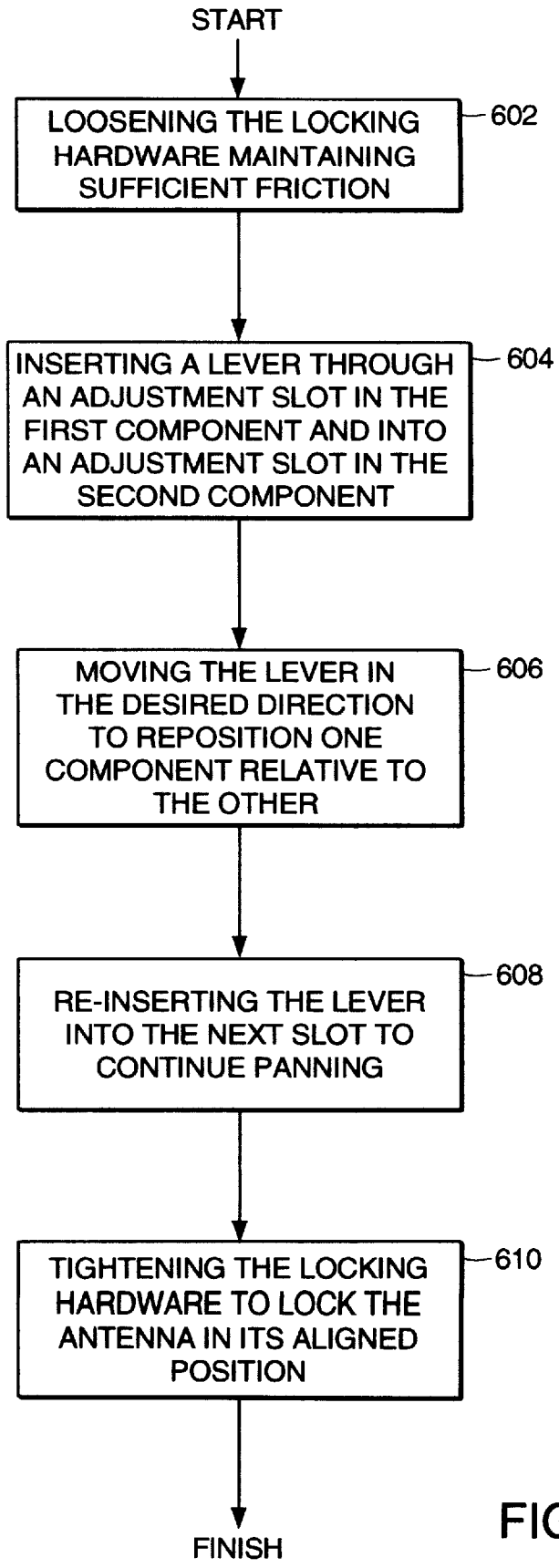
FIG. 6 is a flow chart of the steps used in one method of adjusting the linkage adjustment.

To adjust the azimuthal or the vertical panning of the antenna the following steps may be used as shown in the flow chart of FIG. 6. The azimuth or vertical locking device (see FIGS. 4 and 5) is loosened so the antenna can be panned in azimuth or vertically, but not so that the antenna moves due to the current wind or its weight (Step 602). A common lever, such as, flat blade screw driver or other flat device is inserted through an adjustment slot in the first component or top component and into the slot in the second component or bottom component immediately adjacent (Step 604). The lever, can then be moved in the desired direction to slide one component relative to the other to accomplish azimuth or vertical panning (606). When the lever cannot be moved any farther in the desired direction, it can be removed and re-inserted into the next slot to continue the panning. This can be continued in either direction within the limit of adjustment until proper antenna alignment is reached (608). When the panning is complete, the mount locking device is tightened to lock the antenna in its aligned position (610).

Figure 7:
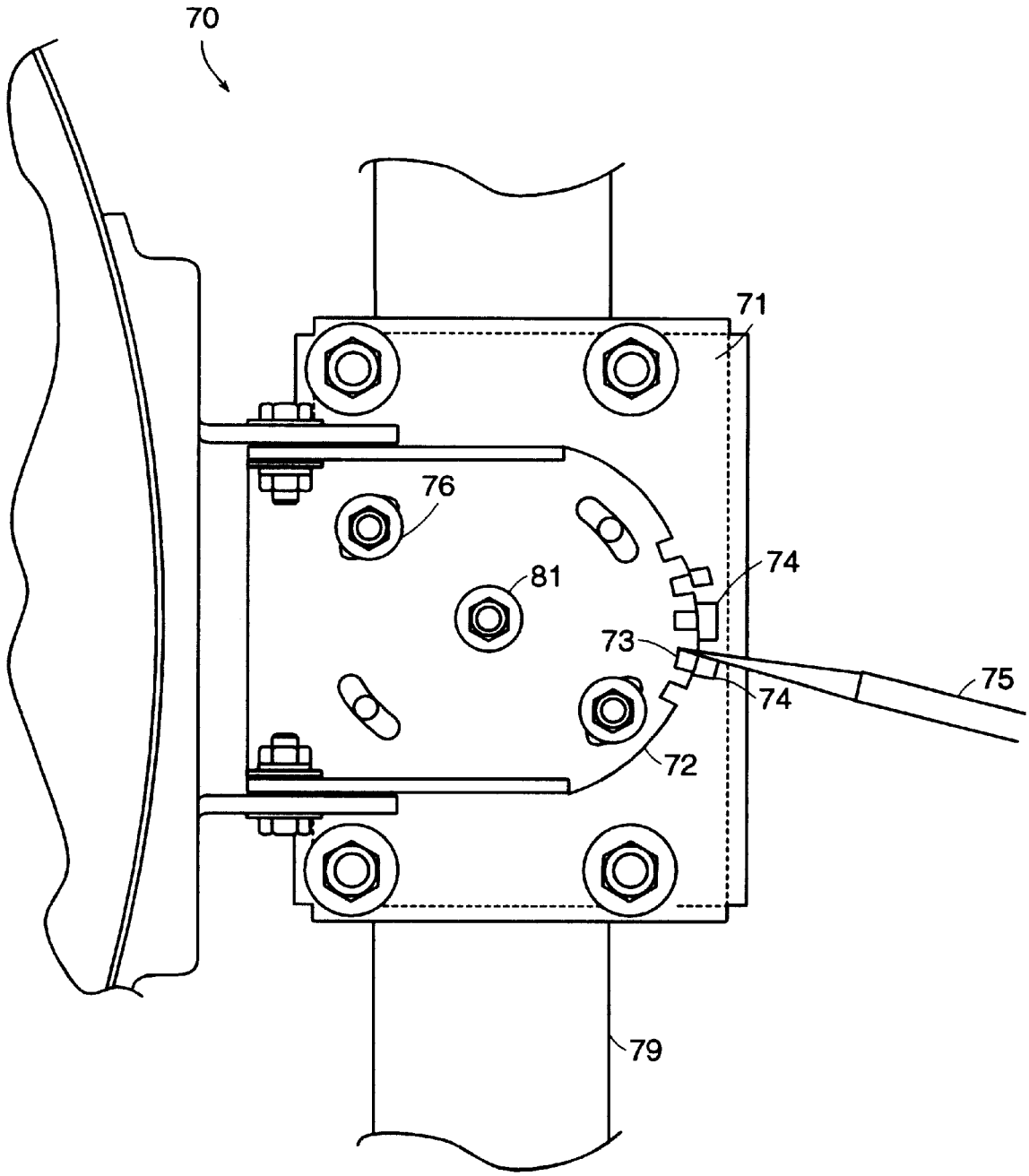
FIG. 7 is a side view of another embodiment of the linkage adjustor in an antenna mount.

Referring to FIG. 7, another embodiment of the invention may be achieved using raised tabs to form adjustment slots. A first component 71 may be formed with raised tabs 74 where a slot is defined between two tabs. A second component 72 may be machined with notches 73. The first component 71 is aligned with the second component 72 in such a fashion that at least one of the slots of the first component 71 overlaps with at least one of the notches of the second component 72. A lever 75 can then be placed through the slot and into the notch of the second component 72. The lever 75 can then be moved so that the components are repositioned relative to one another. The side of the second component 72 that has notches 73 is curved so as to enable the second component 72 to have the ability to rotate about the center bolt or pin 81. The second component 72 is attached to an antenna 77 while the first component 71 remains stationary and is connected to the mounting bracket (not shown) which is in turn connected to a pole 79. By loosening the locking device 76 while maintaining sufficient friction, placing a lever or flat device 75 through a first slot and into a first notch and moving the lever 75, the first component 71 and thus the attached antenna 77 can be panned vertically. The slots and notches are positioned in such a fashion that once the lever has been moved as far as possible, the first component 71 is moved to a position such that a second slot and a second notch overlap. This allows for the lever 75 to be inserted through the second slot into the second notch, the lever to be moved and the antenna to be panned further.

Figure 8:
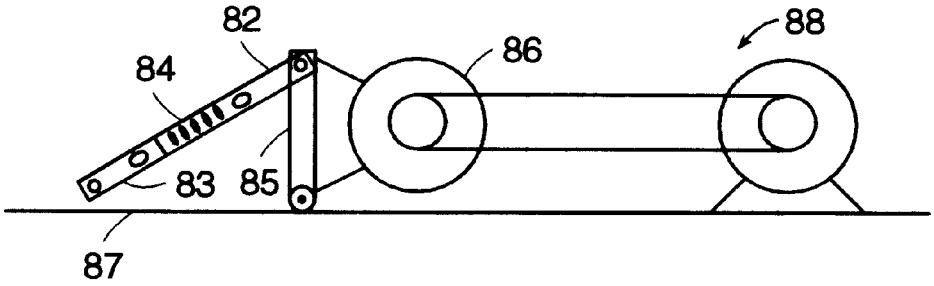
FIG. 8 is a side view of another embodiment of the linkage adjustor in a belt tensioning device.

In another embodiment, the linkage adjustor is part of a belt tensioning device as shown in FIG. 8. The linkage includes two components and a locking device. Each component has adjustment slots 84. The adjustment slots 84 are configured so that an adjustment slot from the first component 82 overlaps with an adjustment slot from the second component 83. A lever may be inserted through the adjustment slots for prying the two components relative to one another. The first component 82 is hingedly mounted to a base or the ground 87 and the second component 83 is hingedly mounted to a member 85. The member 85 is attached to a first rotating component 86 of the belt drive 88 and at one end the member is hingedly attached to the base or the ground 87. By changing the relative position between the first and second component 82, 83 the position of the member 85 and the first rotating component 86 is changed and, as a result, the tension on the belt drive 88 is altered.

Figure 9:
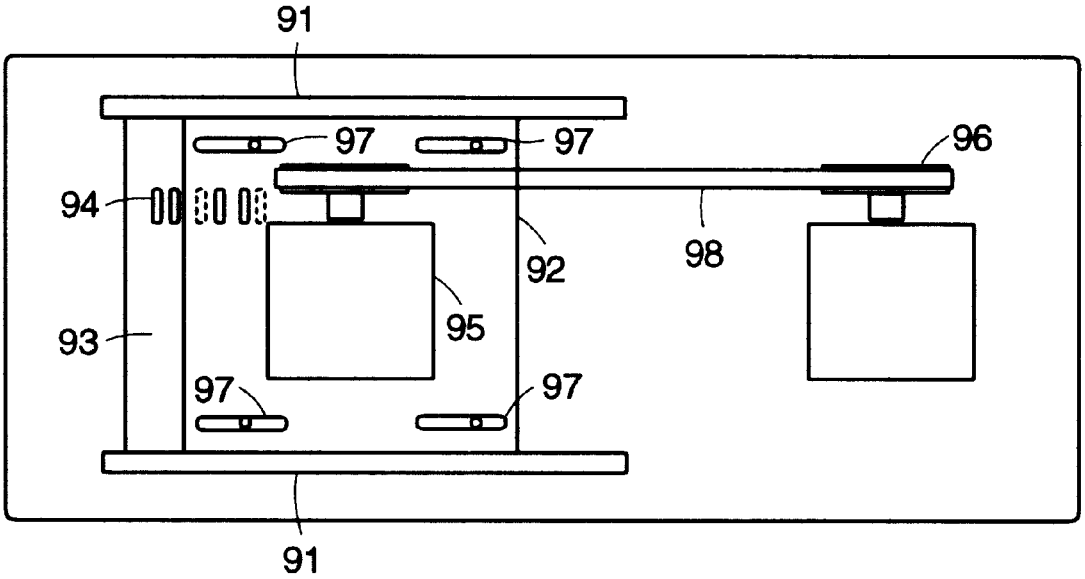
FIG. 9 is a top view of another embodiment of the linkage adjustor in an alternative belt tensioning device.

Referring now to FIG. 9, a second embodiment of the belt tensioning device, the first component 93 is attached to a set of guide rails 91 and is set in a fixed position is shown. The second component 92 resides above the first component 93 and between the guide rails 91. The second component 92 and the first component 93 have adjustment slots 94 which are aligned for receiving a lever through a slot in the second component 92 and into a slot in the first component 93. Attached to the second component 92 is one element from the belt drive 96. As depicted a first rotating component 95 is attached. By repositioning the first component 93 relative to the second component 92 with the lever the belt drive 96 may be tightened or loosened. Additionally locking slots 97 are provided through the second component 92 which align with locking slots from the first component 93 and provide a range over which the two components may be repositioned and correspondingly a range over which belt 98 may have its tension increased or decreased. The locking slots 97 may be provided with bolts or pins for forming a locking device and holding the first and second components 92, 93 in a fixed position.

The advantages of this invention, in its various embodiment, over a screw mechanism is its low cost to produce, and its lack of parts that are susceptible to damage.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. An adjustable linkage comprising:

a first component having a plurality of spaced slots;

a second component having a plurality of spaced slots, where a first slot from the first component overlaps with a first slot from the second component so that a lever may be inserted through the first slot of the first component and into the first slot of the second component to apply a prying force which relatively repositions the components such that a second slot from the first component is brought into overlapping relationship with a second slot from the second component; and a nut and a bolt which hold the first component and the second component in a fixed relative position, wherein the first component has a locking slot and the second component has a locking slot, the locking slot of the first component aligning with the locking slot of the second component and wherein the bolt is placed through the locking slot of the first component and the locking slot of the second component and the nut is connected to the bolt.

2. An adjustable linkage according to claim 1, wherein the plurality of slots from the first component are positioned in a linear path and wherein the plurality of slots from the second component are also positioned in a linear path.

3. An adjustable linkage according to claim 1, wherein the plurality of slots from the first component form an arc having a curvature and wherein the plurality of slots from the second component form an arc having the same center of curvature as the slots from the first component.

4. An adjustable linkage according to claim 1, further comprising a spring washer positioned on the bolt.

5. An adjustable linkage according to claim 1, wherein the plurality of slots on the first component are formed between raised tabs.

6. An adjustable linkage according to claim 1, wherein the plurality of slots on the first component extend completely through the first component.

7. An adjustable antenna mount comprising:

a first component having a plurality of spaced slots and a first hole and wherein the component is connected to the antenna;

a second component connectable to an antenna support having a locking slot and a plurality of spaced adjustment slots, where a first slot from the first component overlaps with a first slot from the second component so that a lever may be inserted through the first slot of the first component and into the first slot of the second component to apply a prying force which relatively reorients the antenna and repositions the components such that a second slot from the first component is brought into overlapping relationship with a second slot from the second component; and a first nut and a first bolt for holding the first and second component in a fixed relative position wherein the locking slot of the second component aligns with the first hole of the first component so that the first bolt may pass through the locking slot of the second component and the first hole of the first component.

8. A mount according to claim 7, where the first hole of the first component is a locking slot.

9. A mount according to claim 7 further comprising a pivot pin placed through a second hole of the first component and a hole is the second component where the pivot pin provides an axis of rotation for the first component with respect to the second component.

10. A mount according to claim 9, wherein the plurality of slots of the first component are arranged in an arc having a curvature and wherein the plurality of adjustment slots of the second component are arranged in an arc having the same curvature as the plurality of adjustment slots of the first component.

11. A mount according to claim 10 further comprising a spring washer positioned on the first bolt.

12. A mount according to claim 7, wherein the plurality of slots on the first component are formed between raised tabs.

13. An adjustable antenna mount according to claim 7, wherein the plurality of slots on the first component extend completely through the first component.

14. A mount for adjusting both azimuth and vertical pitch of an antenna, the mount comprising:

a first component positioned in a first axis having a plurality of spaced slots wherein the first component is connected to the antenna;

a second component having a plurality of spaced slots, the second component positioned in the first axis so that at least one of the slots from the first component overlaps with at least one of the slots from the second component allowing for the first and second components to be relatively repositioned and adjusting the azimuth of the antenna;

a third component positioned in a second axis substantially perpendicular to the first axis, the third component having a plurality of spaced slots wherein the third component is connected to the antenna;

a fourth component having a plurality of spaced slots, the fourth component positioned in the second axis so that at least one of the slots from the third component overlaps with at least one of the slots from the fourth component allowing for the third and fourth components to be relatively repositioned and adjusting the vertical pitch of the antenna;

a first locking device for holding the third component and the fourth component in a fixed relative position; and a second locking device for holding the first and second component in a fixed relative position; said second component and fourth component being connected to an antenna support.

15. A method for adjustment of a linkage, the method comprising:

providing a mount having a first component with a plurality of adjustment slots and a second component having a plurality of adjustment slots where a first adjustment slot from the first component is in overlapping relationship with a first adjustment slot of the second component;

inserting a lever through the first adjustment slot of the first component and into the first adjustment slot in the second component; and moving the lever in a direction to reposition the first component relative to the second component to bring a second adjustment slot of the first component into an overlapping relationship with a second adjustment slot of the second component;

removing the lever from the first adjustment slot of the second component and from the first adjustment slot of the first component.

16. The method of claim 15, further comprising after removing the lever: tightening a locking device to lock the first component and the second component of the mount in position.

17. The method of claim 15, further comprising after removing the lever:

inserting the lever through the second adjustment slot on the first component and into the second adjustment slot on the second component; and moving the lever in the direction to reposition the first component relative to the second component.

18. An adjustable linkage comprising:

a first component having a plurality of spaced slots formed between raised tabs;

a second component having a plurality of spaced slots, where a first slot from the first component overlaps with a first slot from the second component so that a lever may be inserted through the first slot of the first component and into the first slot of the second component to apply a prying force which relatively repositions the components such that a second slot from the first component is brought into overlapping relationship with a second slot from the second component; and a locking device which holds the first component and the second component in a fixed relative position.

19. An adjustable linkage comprising:

a first component having a plurality of spaced slots;

a second component having a plurality of spaced slots, where a first slot from the first component overlaps with a first slot from the second component and a second slot from the first component is in nonoverlapping relationship with a second slot from the second component so that a lever may be inserted through the first slot of the first component and into the first slot of the second component to apply a prying force which relatively repositions the components such that the second slot from the first component is brought into overlapping relationship with the second slot from the second component; and a locking device repositioned by the prying force relative to at least one of the first component and the second component and adjustable to hold the first and second components in a fixed relative position.

20. An adjustable linkage according to claim 19, wherein the plurality of slots from the first component are positioned in a linear path and wherein the plurality of slots from the second component are also positioned in a linear path.

21. An adjustable linkage according to claim 19, wherein the plurality of slots from the first component form an arc having a curvature and wherein the plurality of slots from the second component form an arc having the same center of curvature as the slots from the first component.

22. An adjustable linkage according to claim 19, wherein the spaced slots on the first component are formed between raised tabs.

23. An adjustable linkage according to claim 19, wherein the spaced slots on the first component extend completely through the component.

24. An adjustable linkage comprising:

a first component having a plurality of spaced slots;

a second component having a plurality of spaced slots, where a first slot from the first component overlaps with a first slot from the second component so that a lever may be inserted through the first slot of the first component and into the first slot of the second component to apply a prying force which relatively repositions the components such that a second slot from the first component is brought into overlapping relationship with a second slot from the second component; and a locking device placed through a locking slot in at least one of the first component and the second component, the prying force repositioning the locking device in the locking slot and the locking device adapted to hold the first and second components in fixed relative positions after the repositioning.

25. An adjustable linkage according to claim 24, wherein the plurality of slots from the first component are positioned in a linear path and wherein the plurality of slots from the second component are also positioned in a linear path.

26. An adjustable linkage according to claim 24, wherein the plurality of slots from the first component form an arc having a curvature and wherein the plurality of slots from the second component form an arc having the same center of curvature as the slots from the first component.

27. An adjustable linkage according to claim 24, wherein the spaced slots on the first component are formed by raised tabs.

28. An adjustable linkage according to claim 24, wherein the spaced slots on the first component extend completely through the component.

29. An adjustable antenna mount comprising:

a first component having a plurality of spaced adjustment slots wherein the component is attached to the antenna;

a second component for attachment to an antenna support, the second component having a plurality of spaced adjustment slots and being coupled to the first component at an axis of rotation and where a first slot from the first component overlaps with a first slot from the second component so that a lever may be inserted through the first slot of the first component and into the first slot of the second component to apply a prying force which relatively reorients the antenna and repositions the components about the axis of rotation such that a second slot from the first component is brought into overlapping relationship with a second slot from the second component; and a locking device for holding the first and second component in a fixed relative position.

30. A mount according to claim 29, wherein the first component has a first hole and the second component has a locking slot.

31. A mount according to claim 30, wherein the locking device comprises a first nut and a first bolt;

wherein the locking slot of the second component aligns with the first hole of the first component so that the first bolt may pass through the locking slot of the second component and the first hole of the first component.

32. A mount according to claim 31, where the first hole of the first component is a locking slot.

33. A mount according to claim 31 further comprising a spring washer positioned on the first bolt.

34. A mount according to claim 29, wherein the plurality of adjustment slots of the first component are arranged in an arc having a curvature and wherein the plurality of adjustment slots of the second component are arranged in an arc having the same curvature as the plurality of adjustment slots of the first component.

35. A mount according to claim 29, wherein the adjustment slots on the first component are formed between raised tabs.

36. A mount according to claim 29, wherein the adjustment slots on the first component extend completely through the component.

* * * * *